US006516480B2

(12) United States Patent
Elliott

(10) Patent No.: US 6,516,480 B2
(45) **Date of Patent: *Feb. 11, 2003**

(54) SYSTEM FOR PRODUCING ANTHROPOMETRIC, ADJUSTABLE, ARTICULATED BEDS

(76) Inventor: Franklin E. Elliott, 4387 Motor Ave., Culver City, CA (US) 90232

( * ) Notice: Subject to any disclaimer, the term of this patent is extended or adjusted under 35 U.S.C. 154(b) by 16 days.

This patent is subject to a terminal disclaimer.

(21) Appl. No.: 09/992,808

(22) Filed: Nov. 19, 2001

(65) Prior Publication Data

US 2002/0053109 A1 May 9, 2002

Related U.S. Application Data

(63) Continuation of application No. 09/821,209, filed on Mar. 29, 2001, now Pat. No. 6,347,420.
(60) Provisional application No. 60/196,883, filed on Apr. 12, 2000.

(51) Int. Cl.[7] ..... A61G 7/015
(52) U.S. Cl. ..... 5/618; 5/613; 5/617
(58) Field of Search ..... 5/613, 616, 617, 5/618, 602; 297/83, 342, 354.12, 316, 320

(56) References Cited

U.S. PATENT DOCUMENTS 5,537,701 A * 7/1996 Elliott ..... 5/616
5,790,997 A * 8/1998 Ruehl ..... 297/316

* cited by examiner

*Primary Examiner*—Heather Shackelford
*Assistant Examiner*—Fredrick Conley
(74) *Attorney, Agent, or Firm*—Norton R. Townsley; Belasco Jacobs & Townsley, LLP

(57) ABSTRACT

A system for producing adjustable articulated beds. These beds use measurements taken from a particular human form applied to the bed construction. All beds made using this system have the following in common: a standard distance of four inches from the top of the intended user's head to the head end of the mattress; a mattress that increases in length as the bed is articulated upward and decreases in length when returning to supine position thus matching the change that occurs to the posterior length of the user with no slippage; standardized articulating mechanisms, to articulate the thighs and legs plus and increases the length of the thigh supporting sections when articulated upward, thus matching the movement of the human form; and standardized orbiculators to articulate the torso.

8 Claims, 16 Drawing Sheets

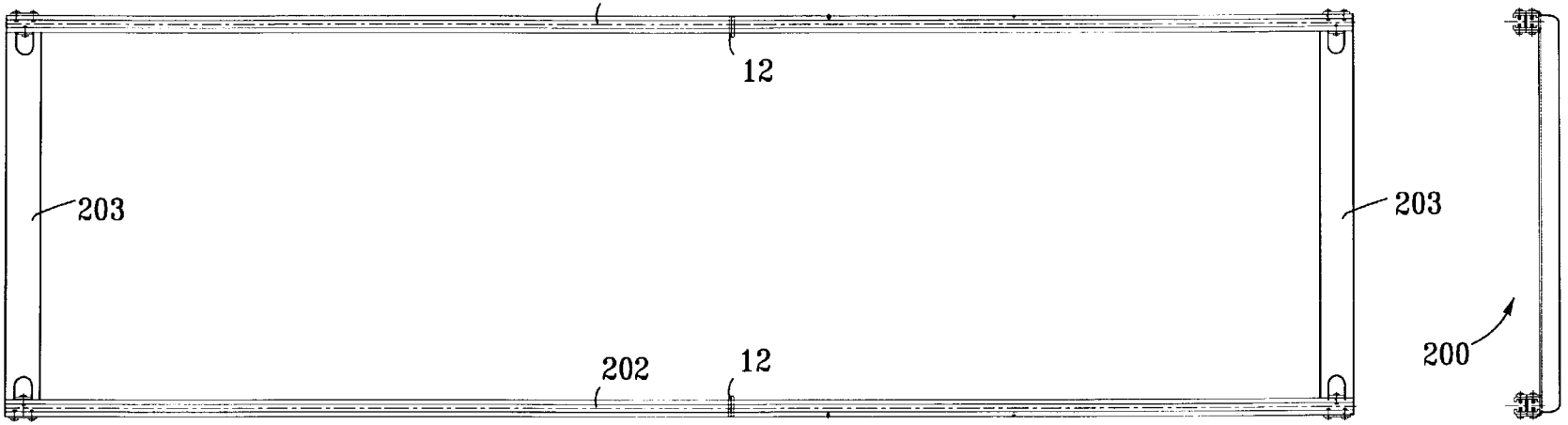
FIG. 2
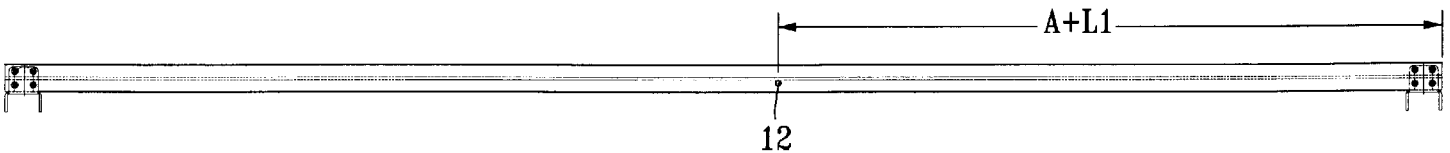
FIG. 1
FIG. 3

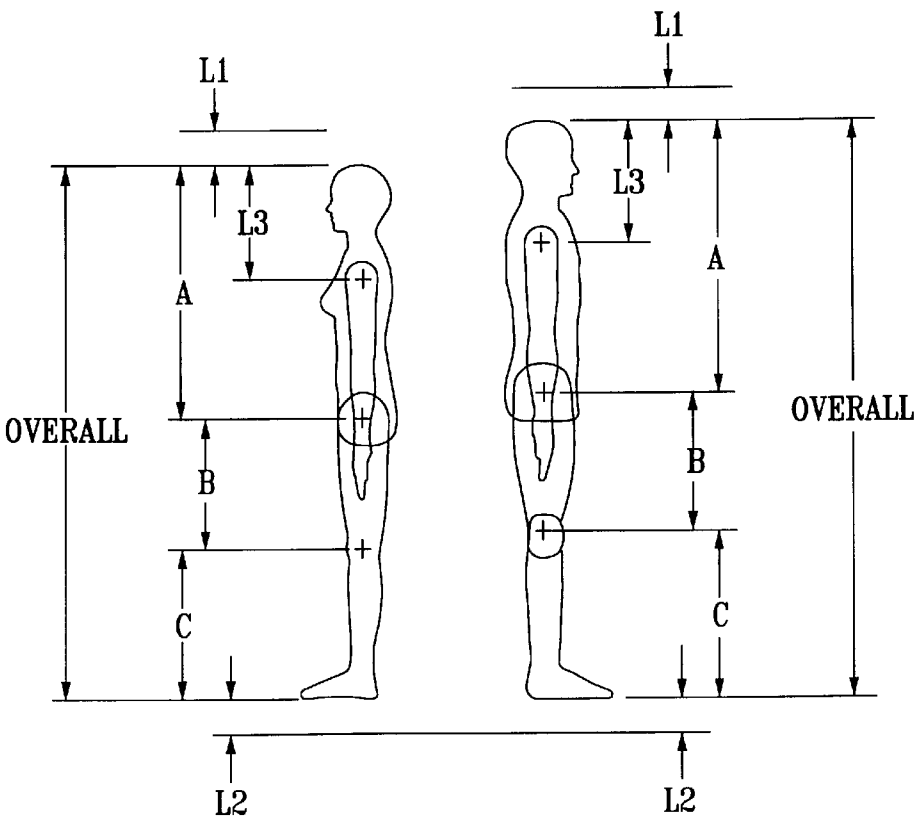
CHART A

| BED SIZE | USER HEIGHT | END TO HEAD | HEAD TO SHOULDER | SUB TOTAL | SHOULDER TO HIP | SUB TOTAL | BACK VARIANCE | HIP TO KNEE | SUB TOTAL | THIGH VARIANCE | KNEE TO ANKLE | SUB TOTAL | FOOT | TO BOTTOM ON FOOT | FOOT TO E.O.B. | KNEE TO E.O.Z. | LEG SEC VARIANCE | BED SIZE |
|---|---|---|---|---|---|---|---|---|---|---|---|---|---|---|---|---|---|---|
| 1-74 | 58 | 4 | 12.6 | 16.6 | 15.4 | 32 | 32 | 13.7 | 45.7 | 13.7 | 13.3 | 59.0 | 3 | 62.0 | 12 | 28.3 | 21.4 | 1 |
| 1-74 | 59 | 4 | 12.8 | 16.8 | 15.7 | 32.5 | to | 13.9 | 46.4 | | 13.6 | 60.0 | 3 | 63.0 | 11 | 27.6 | | 1 |
| 1-74 | 60 | 4 | 13.0 | 17.0 | 15.9 | 32.9 | | 14.2 | 47.1 | to | 13.8 | 60.9 | 3.1 | 64.0 | 10 | 26.9 | to | 1 |
| 1-74 | 61 | 4 | 13.1 | 17.1 | 16.0 | 33.2 | 36.1 | 14.6 | 47.8 | | 14.1 | 61.9 | 3.1 | 65.0 | 9 | 26.2 | | 1 |
| 1-74 | 62 | 4 | 13.3 | 17.3 | 16.3 | 33.6 | | 14.9 | 48.5 | 16.5 | 14.4 | 62.9 | 3.1 | 66.0 | 8 | 25.5 | 28.3 | 1 |
| 1-74 | 63 | 4 | 13.5 | 17.5 | 16.6 | 34.1 | | 15.1 | 49.2 | | 14.7 | 63.9 | 3.1 | 67.0 | 7 | 24.8 | | 1 |
| 1-74 | 64 | 4 | 13.6 | 17.6 | 16.8 | 34.4 | =4.1 | 15.4 | 49.8 | =2.8 | 15.0 | 64.8 | 3.2 | 68.0 | 6 | 24.2 | =6.9 | 1 |
| 1-74 | 65 | 4 | 13.8 | 17.8 | 17.0 | 34.8 | | 15.7 | 50.5 | | 15.3 | 65.8 | 3.2 | 69.0 | 5 | 23.5 | | 1 |
| 1-74 | 66 | 4 | 14.0 | 18.0 | 17.2 | 35.2 | | 16.0 | 51.2 | | 15.5 | 66.7 | 3.3 | 70.0 | 4 | 22.8 | | 1 |
| 1-74 | 67 | 4 | 14.1 | 18.1 | 17.5 | 35.6 | | 16.2 | 51.8 | | 15.8 | 67.6 | 3.4 | 71.0 | 3 | 22.2 | | 1 |
| 1-74 | 68 | 4 | 14.3 | 18.3 | 17.8 | 36.1 | | 16.5 | 52.6 | | 16.0 | 68.6 | 3.4 | 72.0 | 2 | 21.4 | | 1 |
| 2-80 | 66 | 4 | 14.0 | 18.0 | 17.2 | 35.2 | 35.2 | 16.0 | 51.2 | 16 | 15.5 | 66.7 | 3.3 | 70.0 | 10 | 28.8 | | 2 |
| 2-80 | 67 | 4 | 14.1 | 18.1 | 17.5 | 35.6 | | 16.2 | 51.8 | | 15.8 | 67.6 | 3.4 | 71.0 | 9 | 28.2 | 23.4 | 2 |
| 2-80 | 68 | 4 | 14.3 | 18.3 | 17.8 | 36.1 | to | 16.5 | 52.6 | | 16.0 | 68.6 | 3.4 | 72.0 | 8 | 27.4 | | 2 |
| 2-80 | 69 | 4 | 14.5 | 18.5 | 18.0 | 36.5 | | 16.7 | 53.2 | to | 16.3 | 69.5 | 3.5 | 73.0 | 7 | 26.8 | to | 2 |
| 2-80 | 70 | 4 | 14.6 | 18.6 | 18.3 | 36.9 | | 17.0 | 53.9 | 18.1 | 16.6 | 70.5 | 3.5 | 74.0 | 6 | 26.1 | | 2 |
| 2-80 | 71 | 4 | 14.8 | 18.8 | 18.5 | 37.3 | 38.5 | 17.2 | 54.5 | | 16.9 | 71.4 | 3.6 | 75.0 | 5 | 25.5 | 28.8 | 2 |
| 2-80 | 72 | 4 | 15.0 | 19.0 | 18.7 | 37.7 | =3.3 | 17.5 | 55.2 | =2.1 | 17.2 | 72.4 | 3.6 | 76.0 | 4 | 24.8 | | 2 |
| 2-80 | 73 | 4 | 15.1 | 19.1 | 18.9 | 38.0 | | 17.8 | 55.8 | | 17.5 | 73.3 | 3.7 | 77.0 | 3 | 24.2 | =5.4 | 2 |
| 2-80 | 74 | 4 | 15.3 | 19.3 | 19.2 | 38.5 | | 18.1 | 56.6 | | 17.7 | 74.3 | 3.7 | 78.0 | 2 | 23.4 | | 2 |

CHART B

| BED SIZE | USER HEIGHT | END TO HEAD | HEAD TO SHOULDER | SUB TOTAL | SHOULDER TO HIP | SUB TOTAL | BACK VARIANCE | HIP TO KNEE | SUB TOTAL | THIGH VARIANCE | KNEE TO ANKLE | SUB TOTAL | FOOT | TO BOTTOM ON FOOT | FOOT TO E.O.B. | KNEE TO E.O.Z. | LEG SEC VARIANCE | BED SIZE |
|---|---|---|---|---|---|---|---|---|---|---|---|---|---|---|---|---|---|---|
| 3-86 | 72 | 4 | 15.0 | 19.0 | 18.7 | 37.7 | 37.7 | 17.5 | 55.2 | 17.5 | 17.2 | 72.4 | 3.6 | 76.0 | 10 | 33.8 | 25.3 | 3 |
| 3-86 | 73 | 4 | 15.1 | 19.1 | 18.9 | 38.0 | | 17.8 | 55.8 | | 17.5 | 73.3 | 3.7 | 77.0 | 9 | 30.2 | | 3 |
| 3-86 | 74 | 4 | 15.3 | 19.3 | 19.2 | 38.5 | | 18.1 | 56.6 | to | 17.7 | 74.3 | 3.7 | 78.0 | 8 | 29.4 | | 3 |
| 3-86 | 75 | 4 | 15.5 | 19.5 | 19.5 | 39 | to | 18.3 | 57.3 | | 18.0 | 75.3 | 3.7 | 79.0 | 7 | 28.7 | to | 3 |
| 3-86 | 76 | 4 | 15.6 | 19.6 | 19.7 | 39.3 | | 18.6 | 57.9 | | 18.3 | 76.2 | 3.8 | 80.0 | 6 | 28.1 | 33.8 | 3 |
| 3-86 | 77 | 4 | 15.8 | 19.8 | 19.9 | 39.7 | 41.1 | 18.9 | 58.6 | 19.6 | 18.6 | 77.2 | 3.8 | 81.0 | 5 | 27.4 | | 3 |
| 3-86 | 78 | 4 | 16.0 | 20.0 | 20.2 | 40.2 | | 19.1 | 59.3 | | 18.8 | 78.1 | 3.9 | 82.0 | 4 | 26.7 | =8.5 | 3 |
| 3-86 | 79 | 4 | 16.1 | 20.1 | 20.5 | 40.6 | =3.4 | 19.4 | 60.0 | =2.1 | 19.0 | 79.0 | 4.0 | 83.0 | 3 | 26.0 | | 3 |
| 3-86 | 80 | 4 | 16.3 | 20.3 | 20.8 | 41.1 | | 19.6 | 60.7 | | 19.2 | 79.9 | 4.1 | 84.0 | 2 | 25.3 | | 3 |
| 4-92 | 78 | 4 | 16.0 | 20.0 | 20.2 | 40.2 | 40.2 | 19.1 | 59.3 | 19.1 | 18.8 | 78.1 | 3.9 | 82.0 | 10 | 32.7 | | 4 |
| 4-92 | 79 | 4 | 16.1 | 20.1 | 20.5 | 40.6 | | 19.4 | 60.0 | | 19.0 | 79.0 | 4.0 | 83.0 | 9 | 32.0 | 27.4 | 4 |
| 4-92 | 80 | 4 | 16.3 | 20.3 | 20.8 | 41.1 | to | 19.6 | 60.7 | to | 19.2 | 79.9 | 4.1 | 84.0 | 8 | 31.3 | to | 4 |
| 4-92 | 81 | 4 | 16.5 | 20.5 | 21.0 | 41.5 | | 19.8 | 61.3 | 21.0 | 19.4 | 80.7 | 4.3 | 85.0 | 7 | 30.7 | 32.7 | 4 |
| 4-92 | 82 | 4 | 16.6 | 20.6 | 21.3 | 41.9 | 43.6 | 20.0 | 61.9 | =1.9 | 19.7 | 81.6 | 4.4 | 86.0 | 6 | 30.1 | | 4 |
| 4-92 | 83 | 4 | 16.8 | 20.8 | 21.5 | 42.3 | | 20.3 | 62.6 | | 20.0 | 82.6 | 4.4 | 87.0 | 5 | 29.4 | | 4 |
| 4-92 | 84 | 4 | 17.0 | 21.0 | 21.8 | 42.8 | =3.4 | 20.6 | 63.4 | | 20.2 | 83.6 | 4.4 | 88.0 | 4 | 28.6 | =5.3 | 4 |
| 4-92 | 85 | 4 | 17.1 | 21.1 | 22.1 | 43.2 | | 20.8 | 64.0 | | 20.4 | 84.4 | 4.6 | 89.0 | 3 | 28.0 | | 4 |
| 4-92 | 86 | 4 | 17.3 | 21.3 | 22.3 | 43.6 | | 21.0 | 64.6 | | 20.6 | 85.2 | 4.8 | 90.0 | 2 | 27.4 | | 4 |

CHART B

Continued

SYSTEM FOR PRODUCING ANTHROPOMETRIC, ADJUSTABLE, ARTICULATED BEDS

CROSS REFERENCE

The Applicant claims the benefit of his Provisional Application Ser. No. 60/196,883, filed Apr. 12, 2000. This application is a continuation of Ser. No. 09/821,209, filed Mar. 29, 2001, now U.S. Pat No. 6,347,420 currently allowed. The entire disclosure of Applications Ser. Nos. 60/196,883 and 09/821,209 are hereby specifically incorporated by reference.

BACKGROUND OF THE INVENTION

The present invention relates to the field of beds and more particularly to beds which are adjustable for comfort.

The concept of an adjustable bed is perhaps as old as man himself. Once having discovered filling animal skins with dry grass, leaves or feathers the next obvious move was to arrange the filled animal skins in positions of comfort, one for sleeping, another for sitting and perhaps arranging these filled animal skins in what we now refer to as the recumbent position. What is this recumbent position? The definition, not found in all dictionaries being a word not commonly used, is lying down, wholly or partly; reclining; leaning. The word, having several meanings, is not a precise word but may be used to describe a position that is a most comfortable for sleeping but may differ depending on the person. Early man being a creature of comfort like modem man must have discovered ways to improve his comfort but did not leave a record of his progress.

Early adjustable beds were used in hospitals and other facilities which house invalids who are forced to spend extensive periods of time in bed for reasons of health, injury or physical handicap. Then the advent of television created a market for adjustable beds for home use and mass production reduced the cost to where they became affordable to many as a leisure bed.

Throughout the history of the adjustable bed many inventors brought about changes, each making contributions, such as changing from manually operated to motor driven, changing the number of articulated sections, the number of motors, methods of construction, safety features, etc. After a close look at the prior art associated with the many inventions with respect to these inventors we find they labored in the field of hospital or institutional beds purchased mostly by hospitals and institutions. These beds were beds best suited for patient care by doctors and nurses and to a lesser degree the comfort of the patients. Thus we see that comfort was not a major issue in the designs of hospital or institutional type beds.

When television came into vogue enterprising individuals were quick to see a market for adjustable articulating beds as a means to leisurely view television or read in bed. This new market potential sparked the interest of inventors also to labor in finding ways to create new products for this market.

After a close look at the prior art associated with the inventions in respect to leisure beds we find the inventors labored to adapt the adjustable, articulating bed to the leisure market in the same way as was used to design the hospital type beds. They were generally in areas of light weight but sturdy construction, portability, attractiveness, electronics, and mass production, thus reducing the cost based on volume. Some work was done to prevent mattress slippage and add movement to improve access to stationary objects placed alongside the bed. But the added weight and cost to the bed are considered by many to be too great. The current beds, perhaps due to their heritage are still lacking in comfort, some of which is also due to the continuing the one size fits all approach and the lack of a good marriage between the bed and its mattress.

Development of a system for producing anthropometric and quasi-anthropometric adjustable, articulating beds using a combined articulating and orbiculating motion which can match the articulation of human forms in all their individual variances within a given size range represents a great improvement in the field of adjustable beds and satisfies a long felt need of adjustable bed designers and users.

SUMMARY OF THE INVENTION

Accordingly, it is the object of the present invention to provide a system for producing anthropometric and quasi-anthropometric adjustable, articulating beds using a combined articulating and orbiculating motion that, in a complimentary manner, matches the articulation of human forms in all their individual variances within a given size range of five to seven feet tall, thus covering ninety-eight percent of the world population. The anthropometric type, adjustable articulating bed is matched to a particular human form by actual measurements of the intended user, using the link length measuring system, then applying the data in the construction of the bed. There are three measurements necessary to match the bed to the intended user: the overall height, the distance from the top of the head to the hip pivot point, and the distance from the hip pivot point to the knee pivot point. The overall height determines the proper frame and mattress length; the distance from the top of the head to the hip pivot point determines the location of the intended user in relationship to the head end of the mattress and the length of the torso supporting sections; and the distance from the hip pivot point to the knee pivot point determines the length of the thigh supporting sections. All other data required to produce the bed can be calculated. Upper bed frames and mattress lengths are made in four standard lengths: small, seventy-four inches; medium, eighty inches; large, eighty-six inches; and extra large, ninety-two inches. Thus the small upper frame and mattress are suited for users five to five and one half feet tall; the medium frame and mattress is suited for users five and one half to six feet tall etc.

There are three types of components that articulate the beds: an actuator having two motors, and two double reduction gears packaged in one split gear case; an articulating mechanism having components to articulate the lower legs, thighs, and increase the length of the thigh support sections when pivotally articulated upward; and two orbiculators which orbitally articulate the torso using a combined motion from the module. The actuator powers two parallel torque tubes that pass through the gear case at opposite ends, one powers the module, and the other powers the orbiculators. The torque tubes are connected to the module using two quick release type couplings and one coupling to each of the two orbiculators making the actuator "free floating" within the upper bed frame. Since the torque tubes are a fixed distance apart, the module and the orbiculators must also be a fixed distance apart.

Secondly, since the bed mechanisms are made in two widths the actuators must also be made to match by having the torque tubes vary in length accordingly. Having established that a fixed relationship must exist in regard to the location of the actuator, the module, and the orbiculators, relative to each other as a unit, or "cluster", the cluster can be located variably within the bed frame to match the requirements of the intended user. This feature is mandatory in making an anthropometric or quasi-anthropometric bed and part of the present invention.

The selection of materials and processes used to construct anthropometric type beds is important for several reasons: firstly, size, to produce beds ranging in length from seventy-four to ninety-two inches, weight and strength becomes a critical factor, thus engineered aluminum alloy extrusions are used extensively for frames and articulating support sections; secondly plastic extrusions are used for wear surfaces; (extrusions provide a way to make parts that are similar except for length); thirdly steel stampings are used where high stress is a factor, (these parts are usually plated with zinc). Aluminum alloy die-castings are used to make the actuator gear cases and the orbiculator gear cases that require a minimum amount of machining after casting and trimming. The orbiculator rotors are centrifugally cast, trimmed and used "as cast".

In summation it is the size of the intended user that controls how anthropometric beds are constructed; the overall height controls the frame and mattress length, and the associated parts used in connection with the frame size selected; the dimension from the top of the head to the hip pivot point controls the location of the "cluster of components" within the bed frame and the length of the torso supporting sections. Quasi-anthropometric beds are identical to anthropometric except they are made to accommodate a particular group of people having incremental heights and having proportional common skeletal forms, or groups of people having proportional differences related to race or ethnography. The quasi-anthropometric beds are made using sizes and dimensions available from published sources like "Human Scale" by Henry Dreyfuss Associates, M I T Press or other human engineering studies. Demographics may become important especially in large U S cities. All quasi-anthropometric beds are pre-manufactured and selected at the point of sale. Anthropometric beds and mattresses are made for comfort by giving maximum body support, elimination of pressure points, and matched articulation to the intended user throughout the entire range of articulation.

An appreciation of the other aims and objectives of the present invention and an understanding of it may be achieved by referring to the accompanying drawings and description of a preferred embodiment.

BRIEF DESCRIPTION OF THE DRAWINGS

FIG. 1 is a side elevational view of the top frame of this invention

FIG. 2 is top view of the top frame of this invention.

FIG. 3 is an end view of the top frame of this invention.

Chart A is a diagram used to convert measurements of the human form to alpha-terms for use in solving construction formulas.

Chart B is a link length chart of dimensions based on U S population sixty to eighty-four inches tall.

DETAILED DESCRIPTION OF THE PREFERRED EMBODIMENT

FIGS. 1, 2 and 3 illustrate the main frame 200 of this invention 100, which comprises a pair of longitudinal rails 201, 202 and a pair of cross rails 203 attached at the ends of the longitudinal rails 201, 202.

Figure 4:
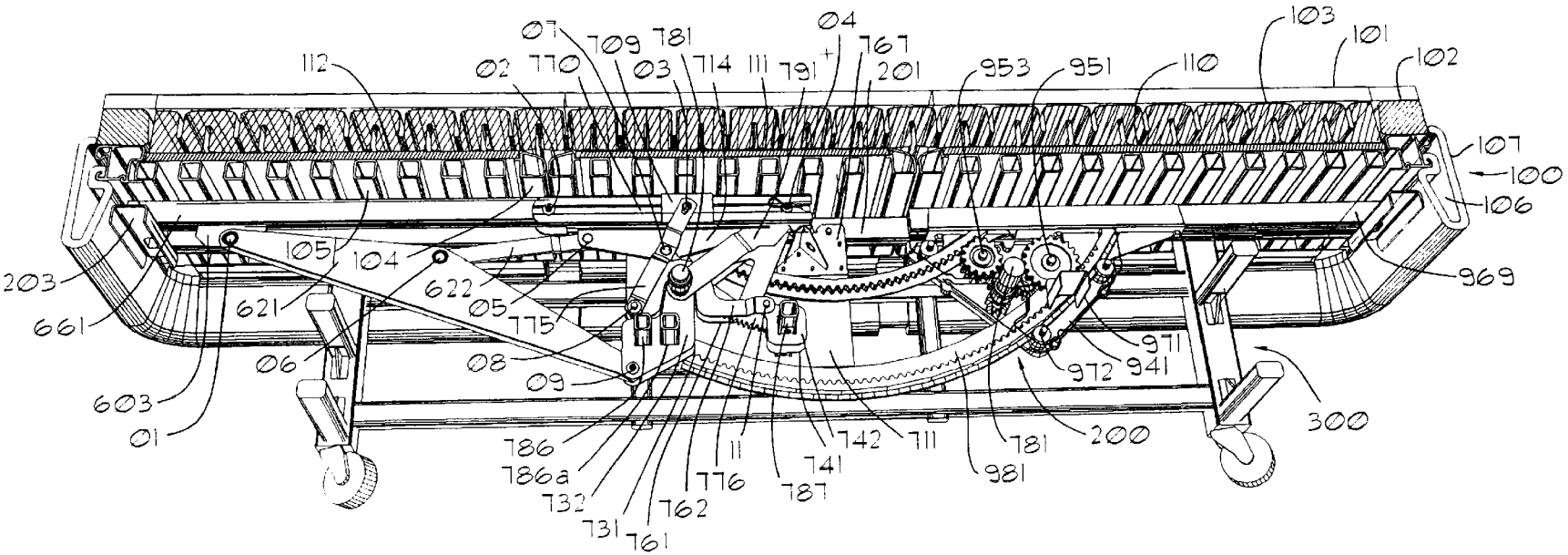
FIG. 4 is a perspective view of a cut section of an anthropometric bed shown in the supine or flat position.
Figure 5:
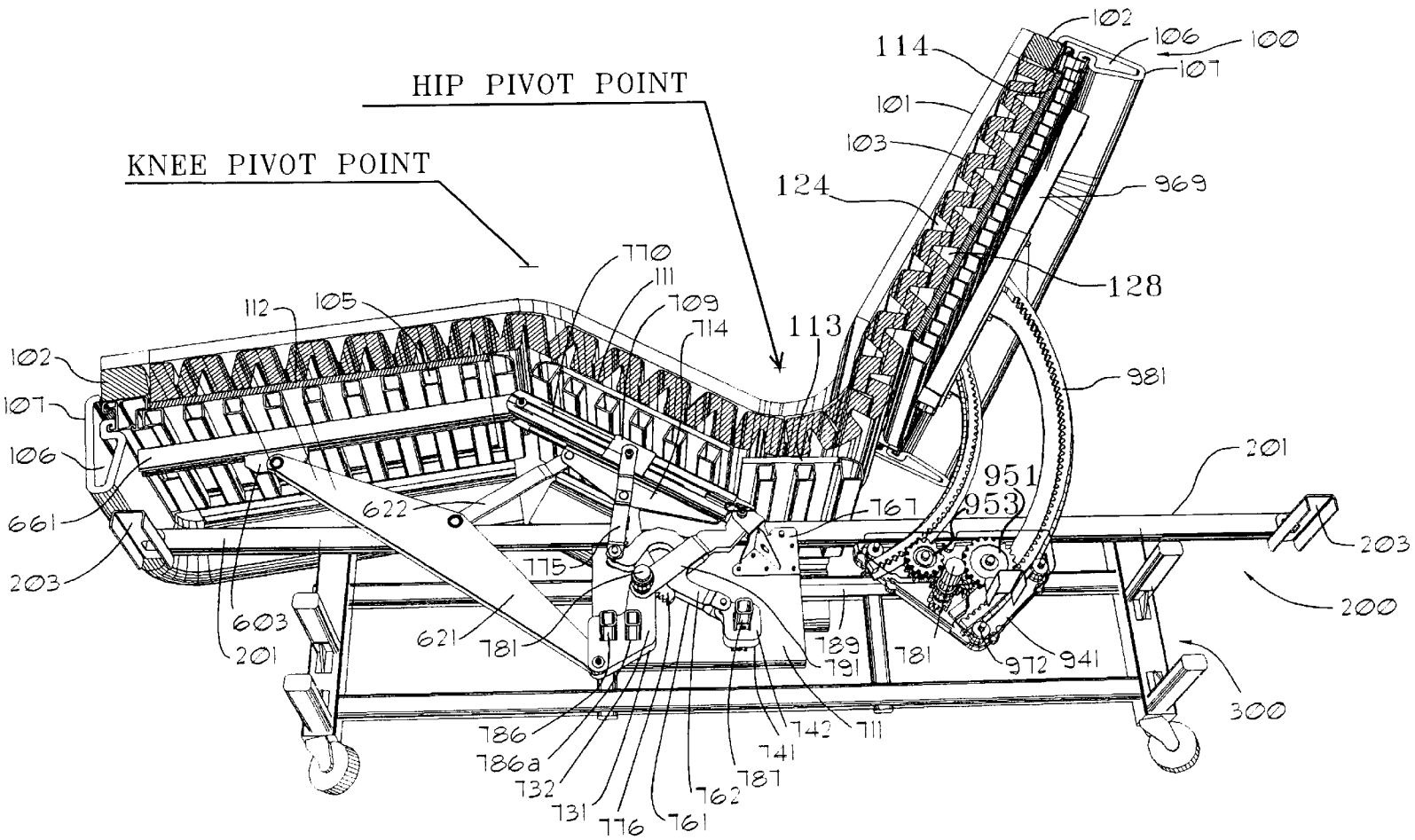
FIG. 5 is a perspective view of a cut section of an anthropometric bed shown in a fully articulated position.

FIG. 4 is a perspective view of a cut section of the anthropometric bed 100 of this invention shown in the supine position. FIG. 5 is a perspective view of a cut section of the anthropometric bed 100 of this invention shown in a fully articulated position. Supporting the main frame 200 is a pedestal base 300 which, in typical fashion, comprises legs, castors and cross members. There is nothing unique about the pedestal base 300. All beds have similar type bases 300.

Above the frame 200 is a mattress 102 and mattress support subassembly. The mattress support has a number of cross bars 105 supporting four pads,—a thigh support pad 111, a leg support pad 112, a coccyx support pad 113, and a lumbar support pad 114. Preferably, the cross bars 105 should be of square cross section and hollow to reduce weight. The cross bars 105 are longer than the width of the frame 200. In this way, the bars can rest on the frame when the bed 100 is in the flat configuration. A skirt 106 is attached around the periphery of the cross bars 105 and pads 111, 112, 113, 114 in order to keep the assembly together and provide a lip 107 for containing the mattress 102.

The cross bars 105 underlying the coccyx support pad 113 are fastened directly to the frame 200. The other cross bars 105 are connected to a leg support bar 661, a thigh support subaseembly 770, and a torso support bar 969. The thigh support subassembly 770 is extensible, via a mechanism to be described later, while the other support bars 661, 969 are of fixed length. The thigh support subassembly 770 is pivotally attached at one end to a bracket 767 (pivot point 04 on FIGS. 7 and 8) and at the other to the end of the let support bar 661 (pivot point 02 on FIGS. 7 and 8). Since the bracket 767 is attached to the frame member 201, the thigh support assembly 770 is effectively pivotally attached at one end to the frame 200. Pivot point 02 must be vertically directly under the knee pivot point of the user.

Supporting and moving the leg and thigh support bars 661, 770 is an articulating mechanism 700, which is attached to the frame 200. The purpose of the articulating mechanism is to tilt and leg and thigh support bars 661, 770 up and down while extending and retracting the thigh support subassembly 770. Supporting the torso support bar 969 is an orbiculator 900 which is also attached to the frame 200. The purpose of the orbiculator 900 is to raise and lower the torso support bar 969 around a pivot point located at the hip.

Preferably the articulating mechanism 700 has a roughly rectangular end plate 711 which is attached to the frame 200 via an attachment bracket 767. The end plate 711 has a slotted aperture oriented vertically for alignment with a roll pin 12 extending from the upper frame rail 201 or 202, used to locate the mechanism 700 in its proper position under the upper frame rail 201 or 202, and a single hole 13 generally located below the oval aperture and used to affix a link 789 for spacing an orbiculator 900 relative to the mechanism 700. See FIG. 1. The upper portion of each end plate 711 is offset formed to provide a horizontal flat surface that extends under the upper frame rail 201 or 202, for attachment with screws. The bracket 767 also forms a pivot point for one end of the thigh support subassembly 770 and a stirrup 791. The other end of the stirrup is fastened to a pair of spaced apart fittings 731, 732. A drive pinion 777 between these fittings 731, 732 drives a gear segment 776. The upper end of the gear segment 776 is pivotally attached to a link 714 which underlies the thigh support subassembly 770. The link 714 has a triangular shape with pivot points at the upper and intermediate angles. The drive pinion 777 is driven by a motor 504 (see FIG. 17 through a connection 781.

There are also a pair of drag links, 761, 762 which are fastened to a pair of anchor brackets 741, 742. The drag links 761, 762 incorporate a bend so that they do not interfere with the fittings 731, 732 when the mechanism 700 is in the flat or zero position. The other ends of the drag links 761, 762 are pivotally fastened to a lever 775 which pivotally attaches to the link 714 at its intermediate angle and then slidably to the thigh support subassembly 770 via a thrust plate 709. At the upper angle of the link 714 is pivotally attached a second lever 622. This lever pivotally attaches to a bellcrank 621, which is pivotally attached at its other corners to the fittings 731, 732 and the leg support bar 661. The latter connection is made via a sliding plate 603. The plate 603 slides inside a channel in the leg support bar 661.

Figure 8:
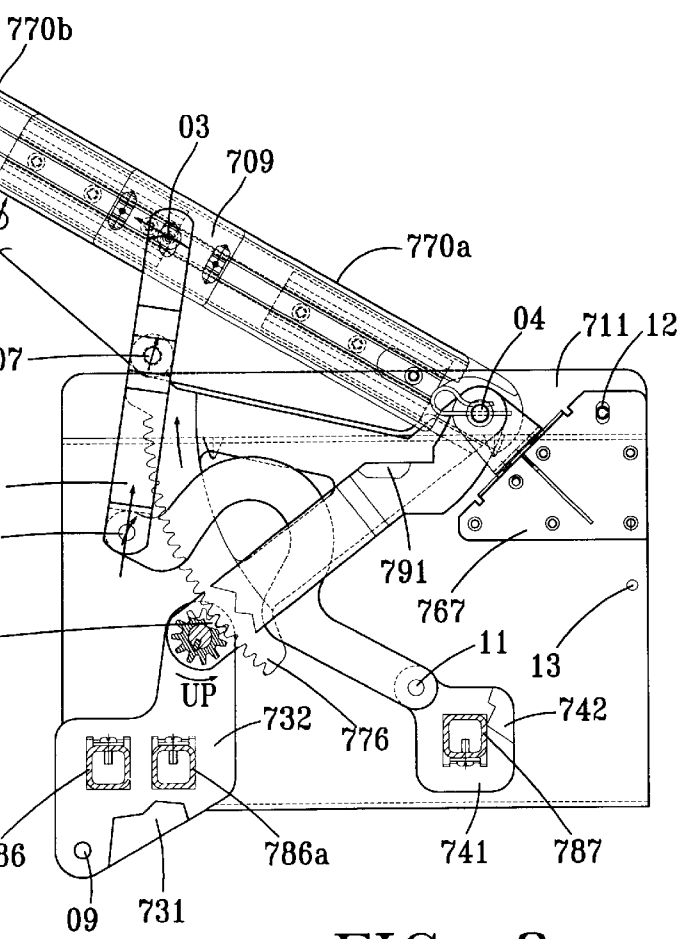
FIG. 8 shows a section view of the articulating mechanism of this invention in the thirty degree position.
Figure 7:
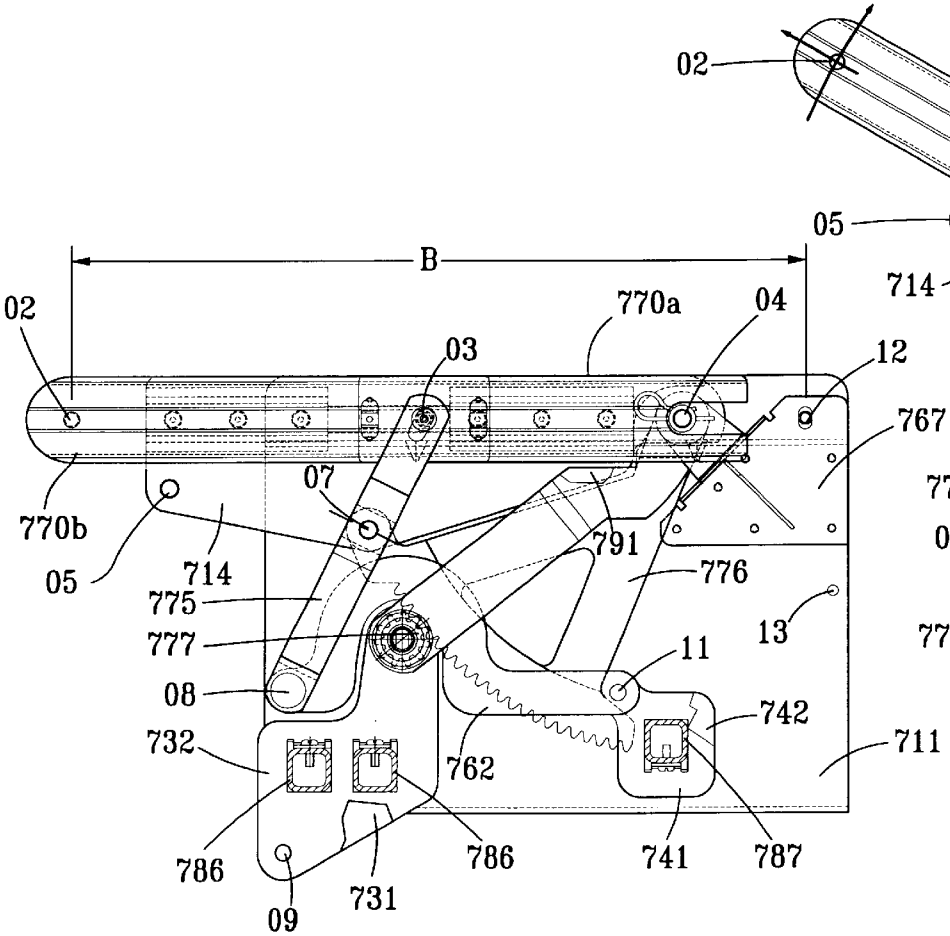
FIG. 7 shows a section view of the articulating mechanism of this invention in the flat or zero position.

Operation of this articulating mechanism 700 can be better appreciated from FIGS. 7 and 8. FIG. 7 shows a section view of the articulating mechanism in the flat or zero position, while FIG. 8 shows a section view of the articulating mechanism in the thirty degree position. As the pinion gear 777 is rotated counterclockwise the gear segment 776 is driven upwards, which tilts the leg support subassembly 770 upwards around pivot 04. As this happens, the constraints of the drag links 761, 762, the lever 775 and the bellcrank 714 at pivot points 11, 08, 07, 03 and 04, force the thigh support subassembly 770 to extend. As can be better appreciated from FIGS. 7 and 8, the thigh support subassembly 770 is actually comprised of two bars 770*a*, 775*b* which slide inside each other. The link 775 is actually attached to the end of one of these bars 770*b* and the thrust plate 709 can slide. This comprises an extending mechanism.

Figure 9:
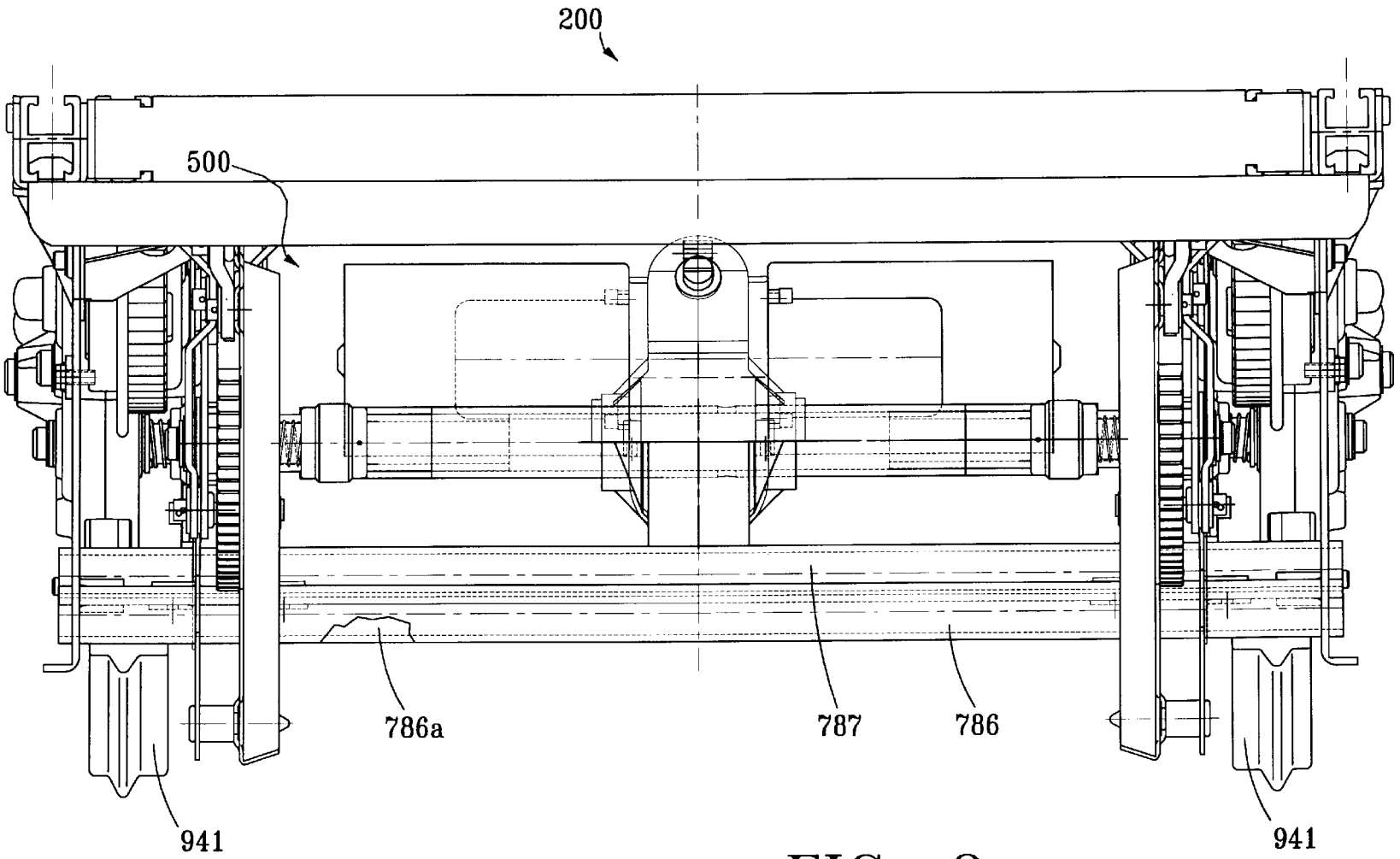
FIG. 9 is an end view of the power mechanism of this invention
Figure 10:
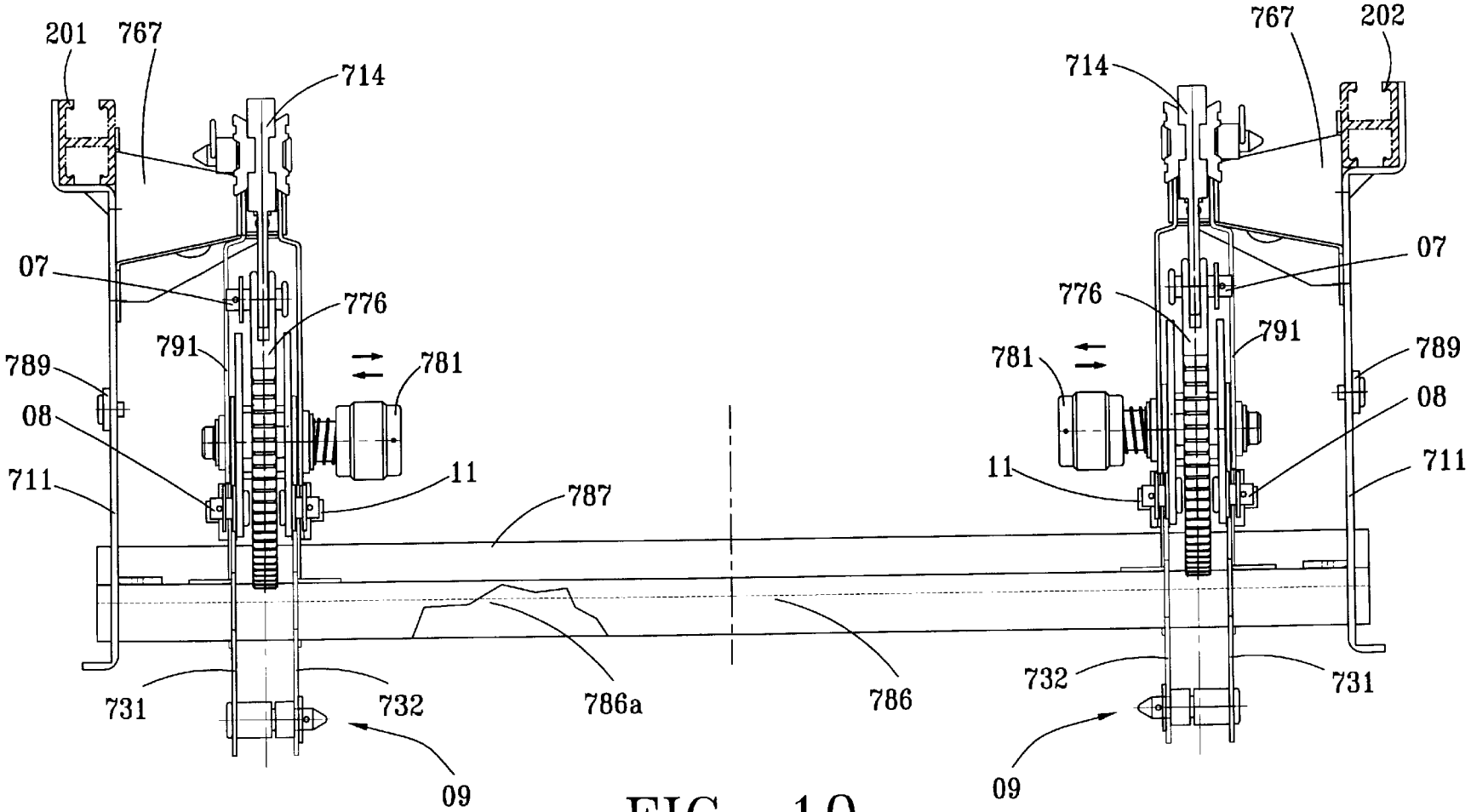
FIG. 10 is an end view of the articulating mechanism of this invention.

Returning to FIGS. 4 and 5, there are three square apertures for receiving three lateral square tubes 787, 786*a*, 786. Each of the apertures have a pierced hole used to locate and secure the three lateral square tubular support members 787, 786*a*, 786. The lateral tubes 787, 786*a*, 786 can be better seen in FIGS. 9 and 10.

Figure 11:
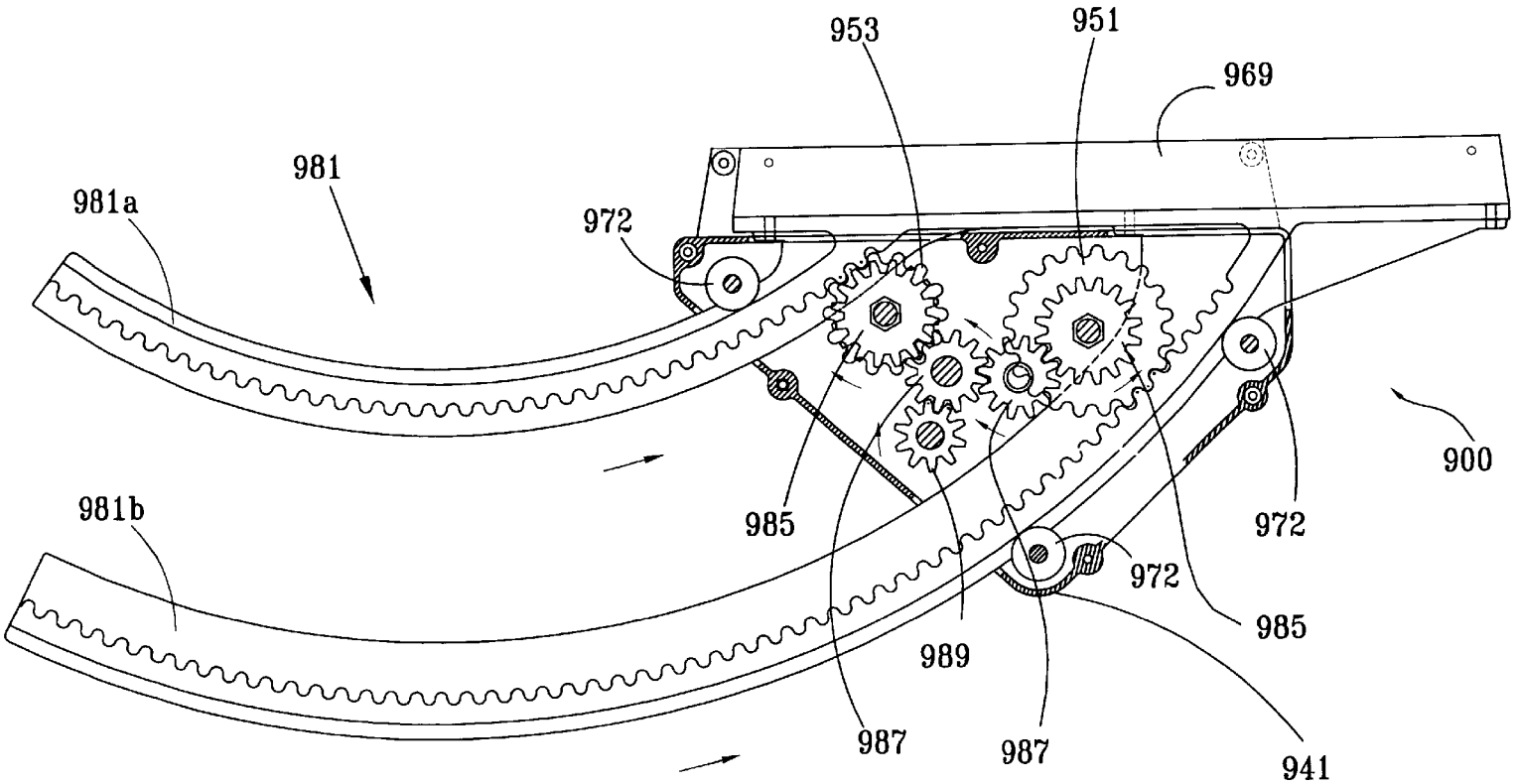
FIG. 11 is a cross-sectional view of a right hand orbiculator showing the gearing and their motion.

FIG. 11 is a cross-sectional view of a right hand orbiculator 900 showing its gearing and motion. The idea of an imaginary or center less hinge has been around for years and that it would solve the problem of pinching of the buttocks, a common problem in all adjustable beds. However, up to now, there has been no way to provide a center-less hinge to adjustable beds. The orbiculator 900 solves the problem and is part of the present invention. Early in the industrial revolution there was seen a need to standardize the making of gears. This need was filled using a standard known as the diametral pitch system. In a diametral pitch system there must be a whole number of teeth on each gear and the increase in pitch diameter per tooth varies according to the pitch. This results in the formula:

$$NT \div P = PD$$

in which NT is number of teeth, P is pitch and PD is pitch diameter. By applying this formula it was evident that two concentric gears, one having external teeth and a larger gear having internal teeth would move the same number of turns if the pitch is common and the ratio of drivers to the driven is common.

Example: an external gear having 168 teeth and a 6 pitch tooth form would have a pitch diameter of 28 inches (168÷6=28). If this 168 tooth external gear was driven by a spur gear having 14 teeth it would require 12 complete turns to move the 168 tooth gear 1 complete turn, or a ratio of 12 to 1. Secondly, an internal gear having 240 teeth and a 6 pitch tooth form would have a pitch diameter of 40 inches (240÷6=40). If this 240 tooth internal gear was driven by a spur gear having 20 teeth it would require 12 complete turns to move the 240 tooth gear 1 complete turn or ratio of 12 to 1. Therefore, if the two drive gears were driven at a fixed speed, the driven gears would rotate at a fixed speed, but only one twelfth as fast. Since the two concentric gears are different, one being an external tooth gear and the other one an internal tooth gear, they would turn in opposite directions. Therefore for the concentric gears to move in the same direction one of the driving gears must be reversed. The reversal of one of the drive gears is not a problem but an advantage will be seen. Rotation of the 168 tooth external gear and the 240 tooth internal gear "in lock step" with each other could be accomplished by locking the two drive gears together, because each of these two gears have the same ratio of 12 to 1 with the driven gears. This can be accomplished by adding two timing gears to the ends of the two drive gears, provided each gear will rotate on the same axis as their respective drive gear; each gear is keyed or locked to their respective drive gear; each gear is the same diameter, has the same pitch, the same number of teeth and be in mesh with each other. Having this accomplished, the two driven gears will move relative to each other.

To drive the entire assembly an additional spur gear is added that drives either of two timing gears. An alternate to this gear arrangement is to add two common idler gears between the two timing gears and drive one of the idlers with the spur gear. The gear arrangement of the present invention has just been described except the drive gears and the driven gears have been altered by changing the normal involute gears to a serpentine or wavy tooth form as will be shown.

In FIG. 11 is shown a right hand orbiculator 900 in the flat bed position with the gear case cover removed. The large 240 tooth internal gear 981*b* and the 168 tooth external gear 981*a* have been segmented and connected together to form one part with the connecting portion being a ninety degree angle used to mount the torso supporting section 969 of the bed. In this view, shown are the serpentine or wavy gear tooth form being applied to the large external gear 981*a*, the large internal gear 981*b*, and the two drive gears 951, 953.

Figure 14:
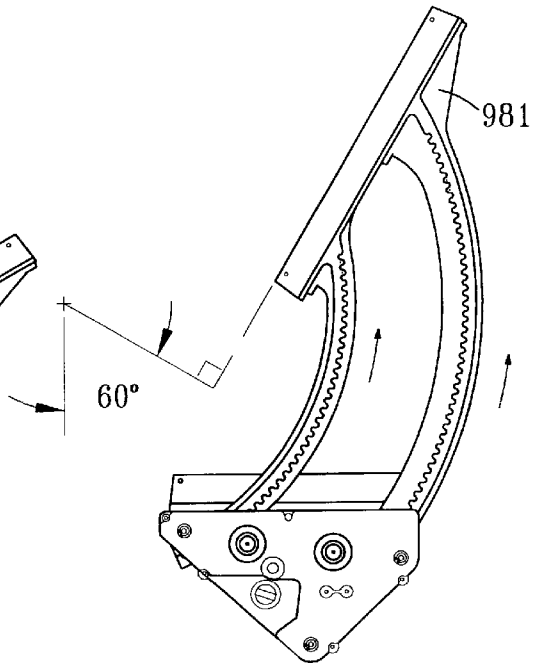
FIG. 14 shows a right hand orbiculator in the sixty degree position.
Figure 13:
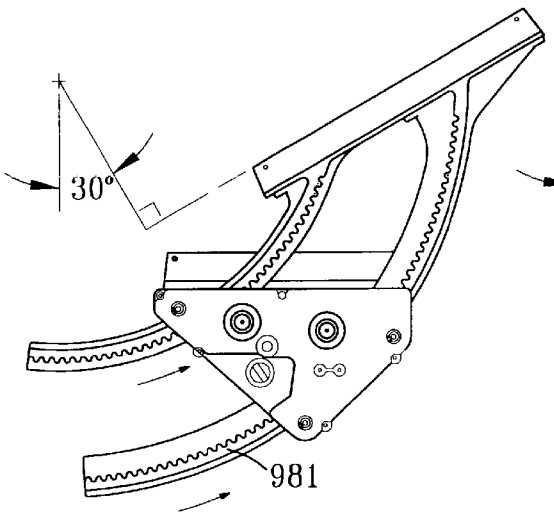
FIG. 13 shows a right hand orbiculator in the thirty degree position.
Figure 12:
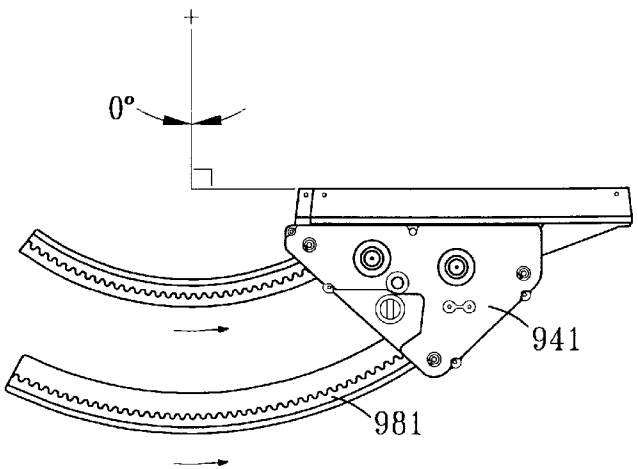
FIG. 12 shows a right hand orbiculator in the flat or zero position.

Also shown are the two timing gears 985 being locked to the two drive 951, 953 gears using hexagon shaped axles passing through each pair of gears. It should also noted that the timing gears 985, idler gears 987, and the spur gear drive 989 are all standard involute gears. It should be noted that timing marks appearing on the driving gears 951, 953 and the driven gears 981*a*, 981*b* including the involute spur gear 989. These timing marks must be observed during assembly while the orbiculator 900 is in the flat position. Three pairs of rollers 972 are used to support and guide the rotor 981 as it passes back and forth radically through the open ended gear case 941. FIGS. 12, 13 and 14 show the motion of a right hand orbiculator 900 in the flat or zero degree, thirty, and sixty degree positions. FIG. 14 shows that the two segmented gears 981*a*, 981*b* have become in actuality two supporting columns.

Figure 6:
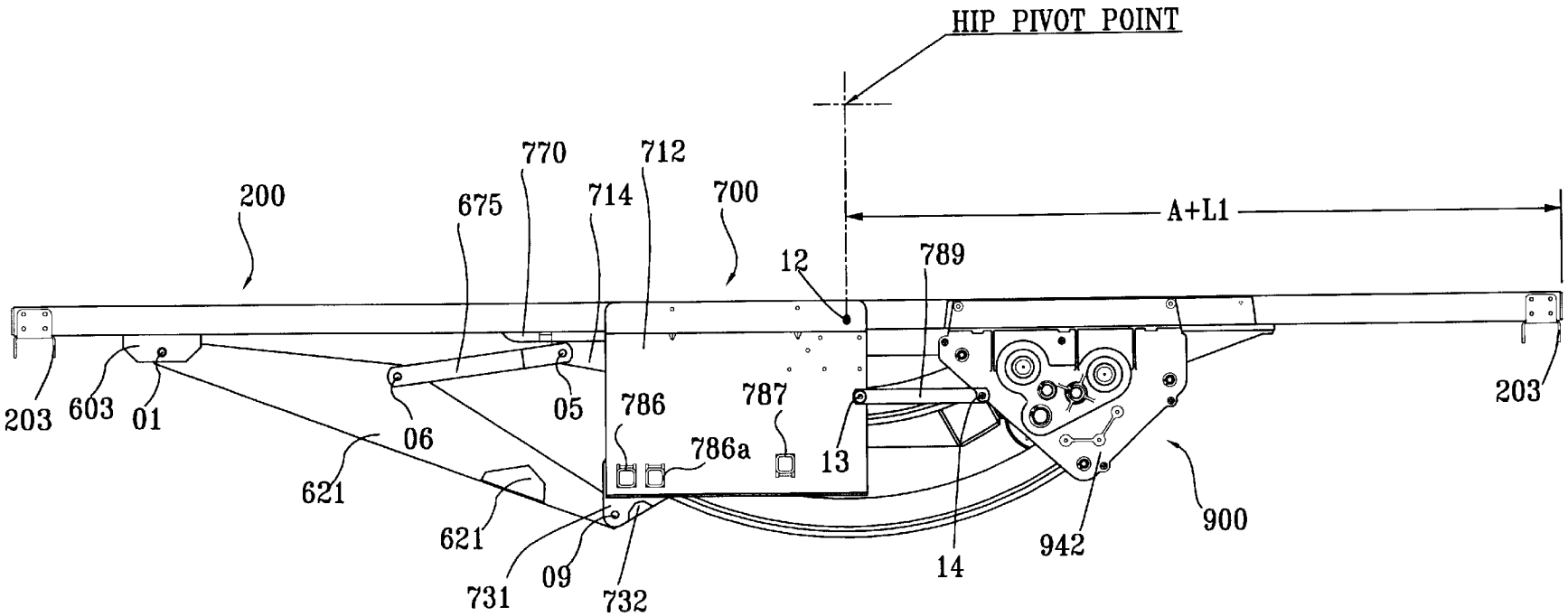
FIG. 6 is a side elevational view of the power mechanism of this invention.

Referring again to FIGS. 4, 5 and 6, one right hand and one left hand orbiculator 900 are mounted under their respective right hand and left hand upper frame rails 201 via the case 941. Two orbiculators 900 are required for each bed, one right hand version mounted under the upper right hand bed rail 201 and one left hand version mounted under the left hand bed rail 201. Each orbiculator 900 has an open ended gear case 941 and cover referred to as a stator and a generally rainbow shaped orbiculating double gear 981 referred to as a rotor.

Figure 15:
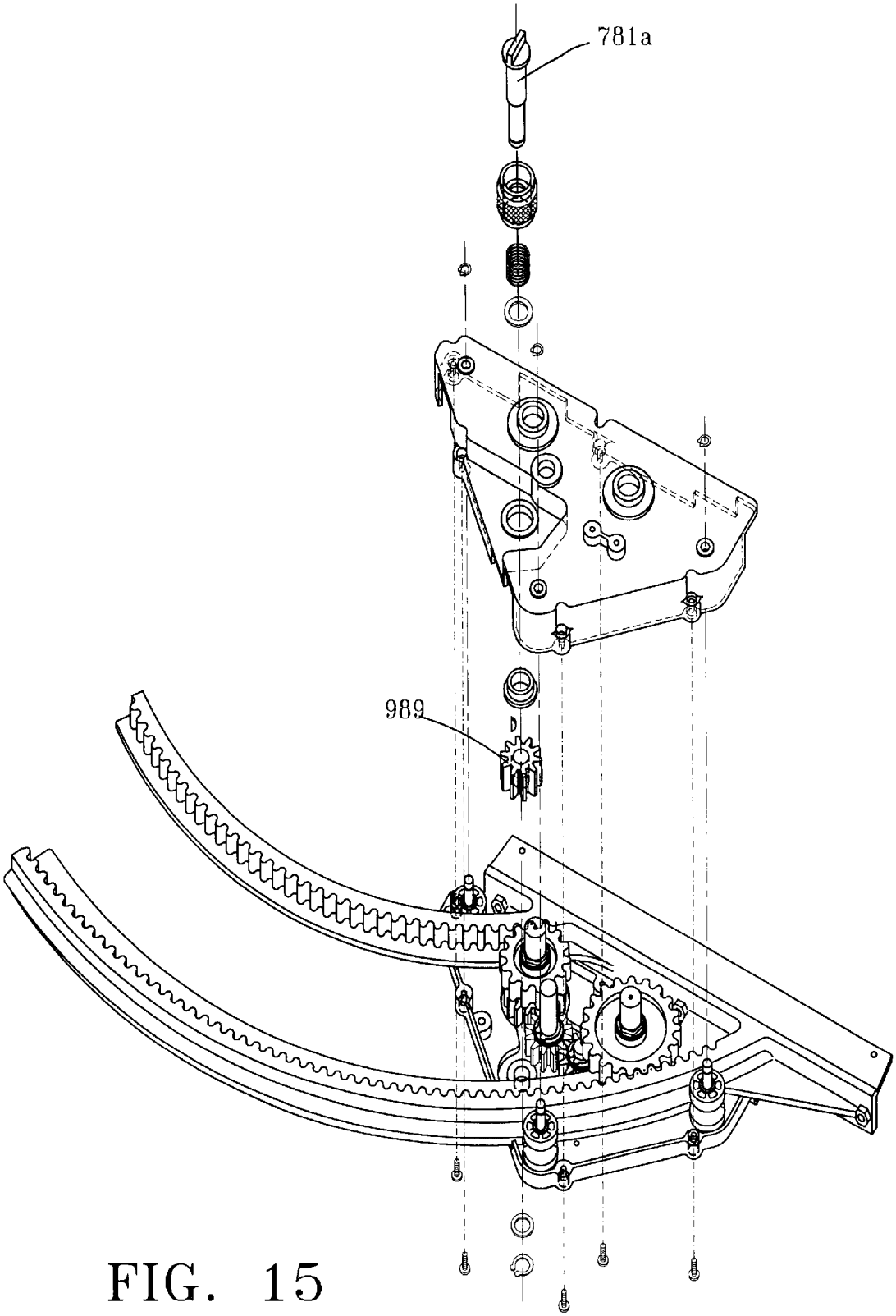
FIG. 15 is an exploded view of a right hand orbiculator.
Figure 16:
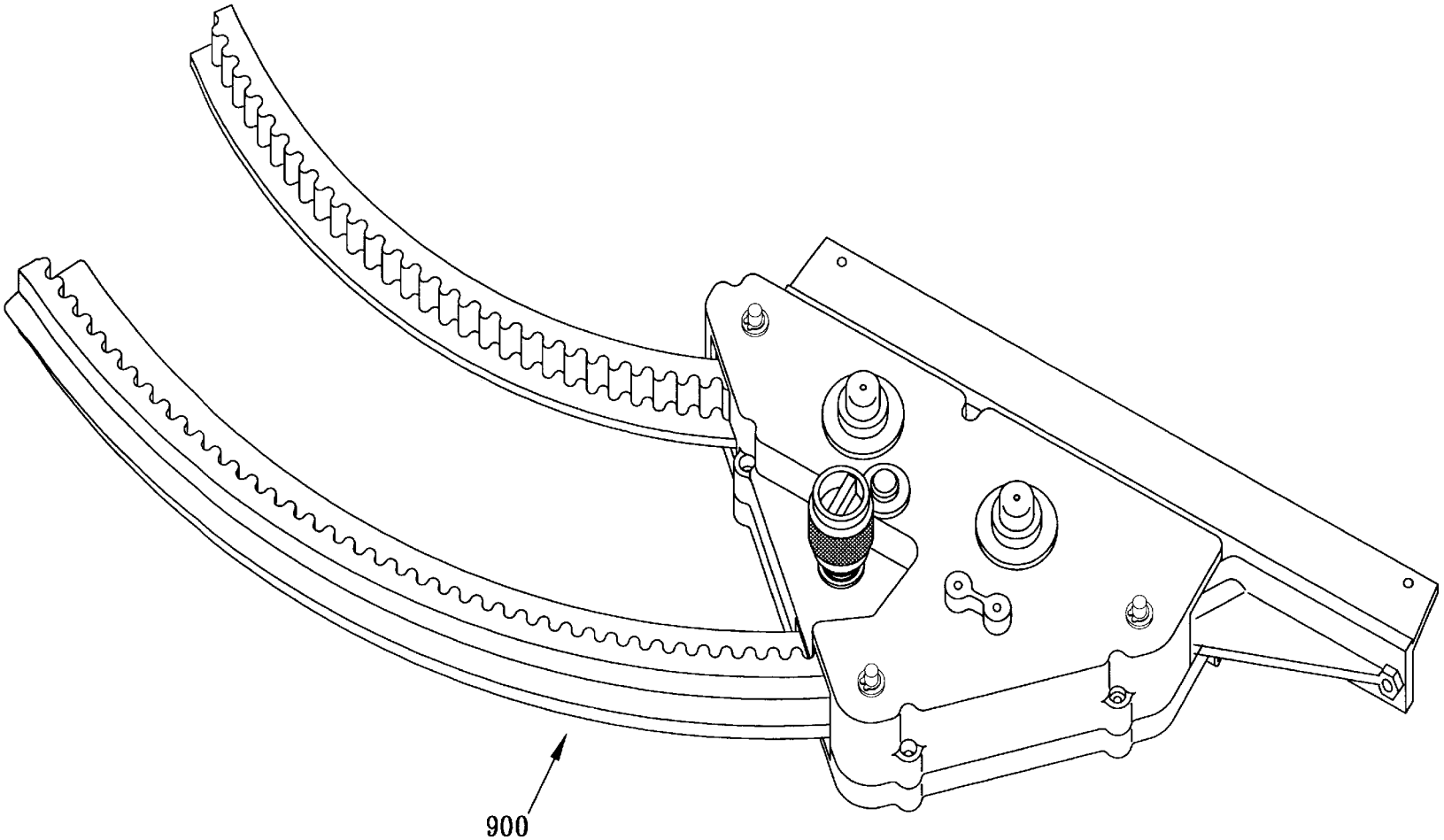
FIG. 16 is a view of a completely assembled right hand orbiculator.

FIG. 15 is an exploded view of a right hand orbiculator 900. The shaft 781 drives the orbiculator 900. FIG. 16 is a view of a completely assembled right hand orbiculator 900.

Figure 17:
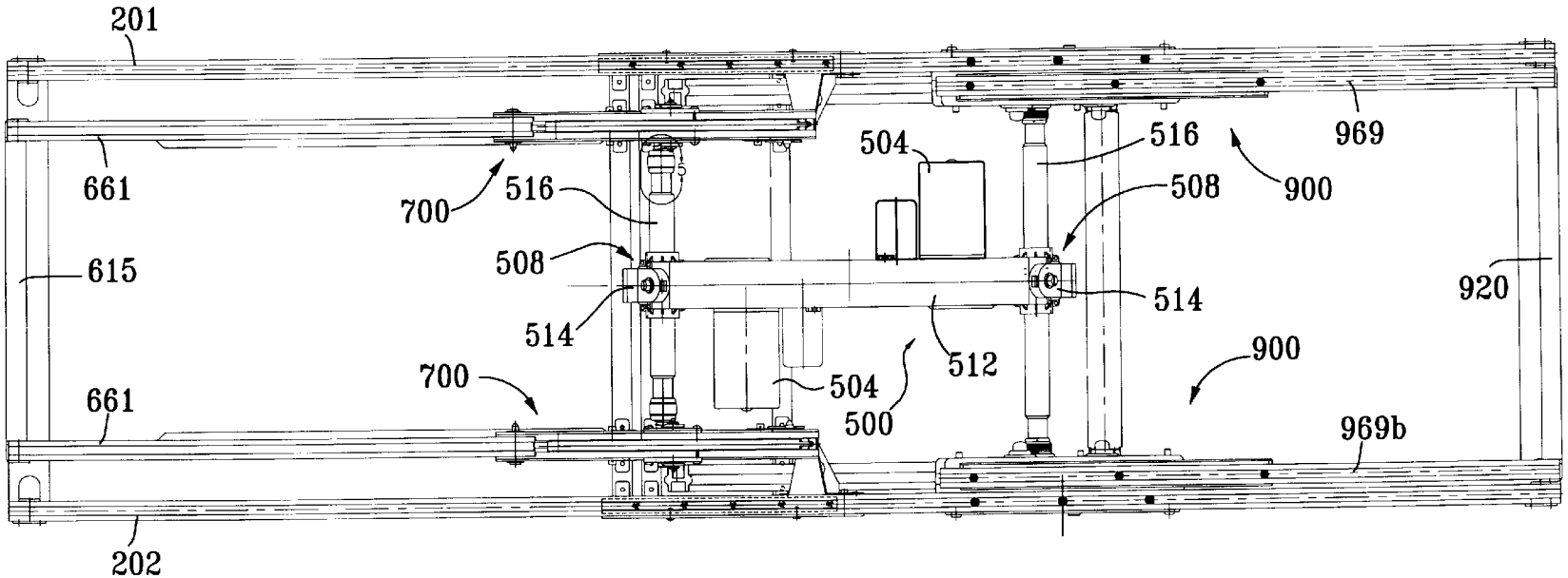
FIG. 17 is a top view of the top view of the power mechanism of this invention.

FIG. 17 shows how power is applied to this invention 100. Power is applied by a dual actuator 500. The dual actuator 500 has two motors 504 (which may vary to match the power supply of various countries such as voltage and cycles) and two double reduction worm gears 508 mounted at opposite ends of a split gear case 512, with two torque tubes 516 passing through each end of the gear case ends 514, one coupled to two orbiculators 900 mounted under each of the upper frame rails 201, 202 and the other coupled to the two spur gears 777 which operate the articulating modules 700.

Figure 18:
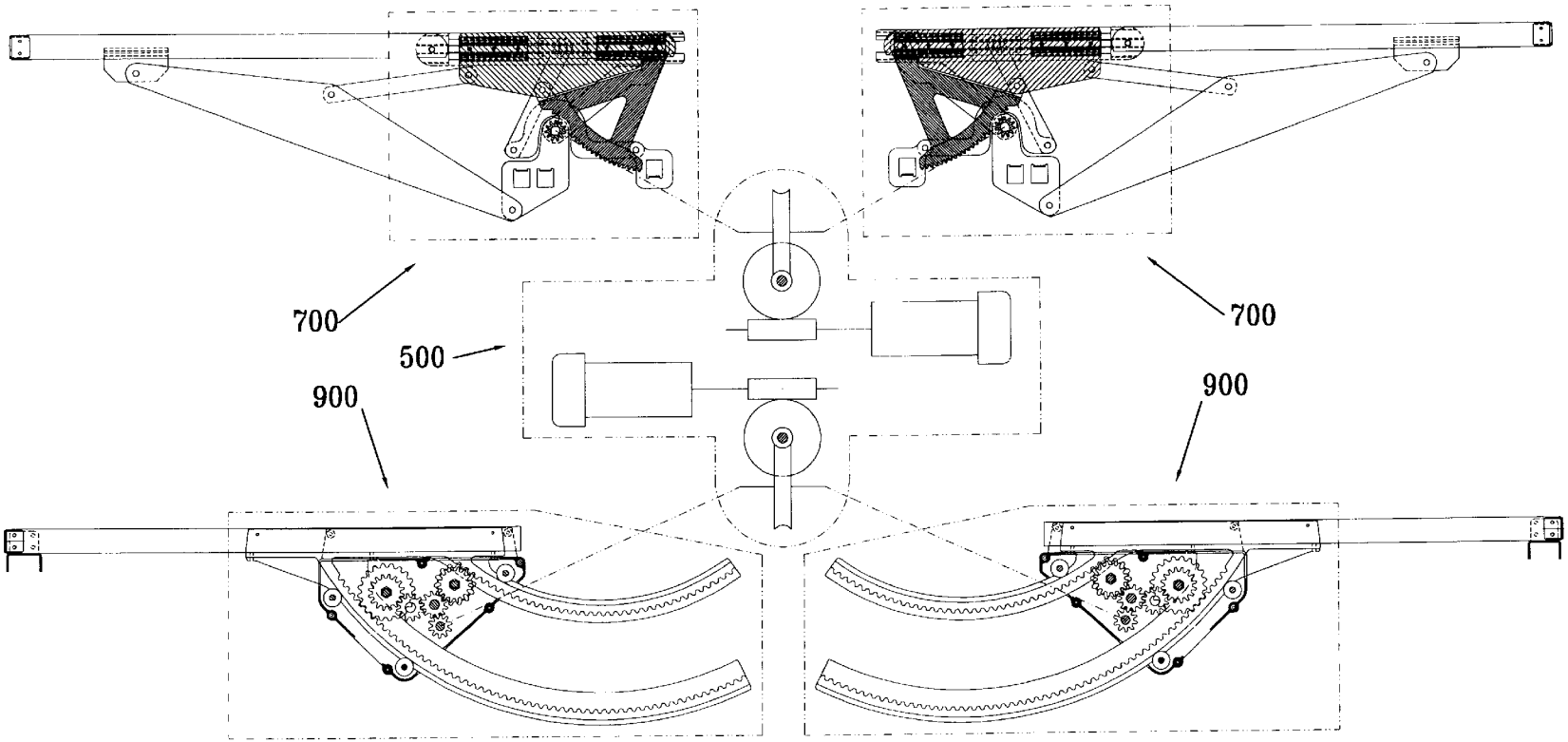
FIG. 18 shows a schematic of the power distribution.

FIG. 18 shows a schematic of the power distribution of this invention 100. It is clear from FIG. 18 that power from the motors 504 is input to the articulating mechanisms 700 via the spur gears, and the orbiculators via the drive pinion connection 781.

Construction of the mattress 102 of this invention is illustrated in FIGS. 4 and 5. The mattress 102 must elongate and contract as the bed 100 is moved from the flat (FIG. 4) to the fully articulated (FIG. 5) position. The mattress comprises a soft top layer 101 and a lower layer 103. The lower layer 103 is supported by the four pads 111, 112, 113 and 114, previously described. The lower layer 103 has a serpentine shape which creates voids 124, 128 in a staggered arrangement from each other. These voids 124, 128 increase in size when the mattress 102 is articulated upwards and decrease in size when the mattress 102 is articulated downwards.

Chart A is a diagram used to convert measurements of the human form to alpha-terms for use in solving construction formulas. Chart B is a link length chart of dimensions based on U S population sixty to eighty-four inches tall.

The system approach to providing beds 100 to an adult population ranging in height from five feet to seven feet tall makes it necessary to use four frame sizes, and two widths for both mechanical and economic reasons. The smallest or—1 upper frame and mattress is 74 inches long and used for people 5 feet to 5.5 feet tall; the medium or—2 upper frame and mattress is 80 inches long and used for people 5.5 feet to 6 feet tall; the large or—3 upper frame and mattress is 86 inches long for people 6 feet to 6.5 feet tall; and the extra large or—4 upper frame and mattress is 92 inches long for people 6.5 feet to 7 feet tall. The sizes listed above will become industry standards because the mattresses 102 for use with both anthropometric and quasi-anthropometric beds are not suited for conventional beds and conventional mattresses are not suited for the beds 100 of the present invention.

In order to produce anthropometric beds for the mass market when the configuration of a bed changes according to the measurements of the intended user, a system approach is necessary, and is a part of the present invention. A close examination of the problem involves the overall length of the parts which must be matched to the measurements of the intended user, and for this reason aluminum and plastic extrusions are widely used and become the raw material for making parts. The extrusions are engineered to maximize strength, minimize mass and reduce weight. A further cost savings accrues from the fact, that paint is not needed to prevent oxidation. Extrusions are easy to cut to length with great accuracy using numerically controlled (n.c.) saws, and the cut ends can be used as reference surfaces for drilling, and milling operations, again using n.c. machines.

To make a anthropometric type bed the first step is the measurement of the intended user or articulee, using the link length system. The link may be defined as the shortest distance between two pivot points. For simplicity the entire spine of twenty-four links may be represented by a single link. Joints are approximations of the center of rotation for various types of hinge joints and can be located by articulating the joint. An example may be locating the knee pivot point by having the subject sit on a tall hard bottomed stool, a stool tall enough to prevent the feet from contacting the floor. While in this position and the subject relaxed gently articulate the lower leg through a normal range of movement. While the leg articulates place a pointer, say the eraser end of a pencil, on the outside of the knee and locate the point in which the pencil remains stationary while the leg is moving and place a dot of vegetable color on the skin at this point, repeat the process to make sure, then use the dot as a measuring point. The hip pivot point can be found in a similar manner.

Referring to Chart A, the first dimension needed is the overall height measured to the nearest inch. This is used to determine the length of the bed using the dash numbers—1 through—4. The general rule is applied of adding a minimum of eight inches or a maximum of fourteen inches to the overall height of the intended user. For example an intended user seventy inches tall would require a—2 frame eighty inches long or 80 inches minus 70 inches equals 10 inches which falls within the eight to fourteen inch range. Or an intended user seventy-three inches tall would require a—3 frame eighty-six inches long or 86 inches minus 73 inches equals 13 inches which falls within the eight to fourteen inch range.

The second dimension A or the distance from the top of the head to the hip pivot point, like all dimensions involving pivot points, is measured to the nearest one tenth of an inch. This measurement is used to locate the hip pivot point relative to the head end of the upper frame rails and also the head end of the mattress. Adding the L1 dimension, a fixed dimension of four inches, to the A dimension results in the dimension needed. This dimension is used to locate the two roll pins 12 driven through each of the two upper frame rails 101, 102 and becomes the first step in making an anthropometric bed, because all assemblies and parts are relative to these roll pins 12. See FIGS. 1 and 6. Using the example of the seventy inch tall intended user having an A dimension of 32.9 inches plus the L1 dimension of 4.0 which equals 36.9 inches. This is the proper dimension to locate the roll pins in a —2 frame 80 inches long. By following the above method of measuring the articulee using the overall height to select the proper frame and mattress length, and using the hip pivot point to the top of the head measurement plus 4.0 inches to locate the position of the roll pins 12 in the upper frame rails 101, 102 locates the articulee in the bed with the top of the head being 4.0 inches from the head end of the mattress.

Again referring to Chart A, the third dimension B or the distance from the hip pivot point to the knee pivot point is required. A careful look at Chart A indicates there are several ways of arriving at the B dimension, however the direct measurement between two dots of vegetable coloring is best and less subject to mathematical errors. The B distance, or distance between the hip pivot point and the knee pivot point, is an important part of the bed 100 construction, however the B dimension is not directly applied to the bed 100 but applied to a complicated mechanism, the articulating mechanism 700, and will be explained later. During the measurement phase two other observations should be listed, weight and body build; both are important in construction, especially of the anthropometric mattress 102. Weight is listed to the closest five pounds and the body build as thin (ectomorphic), muscular (mesomorphic) or rotund (endomorphic).

Quasi-anthropometric adjustable articulating beds 100 and mattresses 102, made for an unknown intended user, or articulee, using the series approach provides a way to mass market the quasi-anthropometric bed 100 without the intrusiveness of taking measurements. The first step is the overall height of the intended user. However, to cover the height range of five feet to seven feet tall inclusive in one inch increments requires twenty five different sizes and to cover two widths, results in fifty different configurations. This is not the end because height is only part of matching the bed 100 to the human form; proportions such as thigh length and distance from the top of the head to the hip pivot point also must be considered. When range, width, thigh length and the top of head to hip pivot point dimension are extended the result is 31,250 different configurations. This is not to say that any manufacturer or retailer would ever consider standardizing all the configurations possible, however it is to say the system presented in the present invention allows the flexibility and the ability to produce any of the many configurations with only the amount of material used as a difference. Once a manufacturer has the means of production (facilities, tooling, materials, labor, supervision, and sales), demographics, customer acceptance, and sales forecasting, a manufacturer could determine what to offer in standard sizes or as special order items. One way could be to standardize by height using only even inch dimensions, (13) sizes, and then apply average dimensions of thigh length and top of head to hip pivot point dimensions from the work of Henry Dreyfuss Associates called "Human Scale" based on US population or some other well known work from the field of human engineering. The quasi-anthropometric beds 100 are thus identical to the anthropometric beds 100 except they are pre-manufactured to certain standard sizes thus offering immediate delivery and can be comparatively selected at point of purchase.

A series of quasi-anthropometric beds 100 and mattresses 102 are made having proportional differences related to race or ethnography. In some countries having a large number of articulees will match a small series of quasi-anthropometric beds 100 and mattresses 102 when properly selected.

All anthropometric types begin with three basic elements; 1) the over-all height of the intended user or articulee expressed in inches, to the nearest inch; 2) the measured distance the top of the head to the hip pivot point A expressed in inches to the nearest tenth inch; 3) the measured distance from the hip pivot point to the knee pivot point B expressed in inches to the nearest tenth inch. The over-all height dimension is applied to select the upper frame length best suited to match the articulate. The system uses as a base, four frame lengths which are referred to by dash numbers,—1 is seventy four, (74) inches long and used for an articulee in the over-all height range of sixty (60) inches through sixty-six, (66) inches; the—2 is eighty (80) inches long and used for an articulee in the over-all height range of sixty-six (66) inches through seventy-two (72) inches; the—3 is eighty-six (86) inches long and used for an articulee in the over-all height range of seventy-two (72) inches through seventy-eight (78) inches; and lastly the—4 is ninety-two (92) inches long and used for an articulee in the range of seventy-eight (78) inches through eighty-four (84) inches. The rule for selecting the proper upper bed frame 200 is: the bed frame 200 should be no less than eight (8) inches longer or fourteen (14) inches greater than the articulee's over-all height.

Referring again to Chart A and selecting a particular human form or articulee to use as a model, selected is the fifty percentile U S male, 70 inches over-all height with an A measurement of 32.9 inches from the hip pivot point to the top of the head and a B measurement of 17 inches from the knee pivot point to the hip pivot point. First select the proper frame length, this would be the—2 frame 80 inches long because it complies to the 8 to 14 inch rule. Next to the A dimension of 32.9 add the L dimension of 4.0 inches for a total of 36.9 inches. This is the distance used to locate and drill two 5/16 diameter holes through each of the two upper frame rails 201 and 202 as shown in FIGS. 1, 2 and 3 at 12. After drilling insert a 5/16 diameter roll pin in each of the two holes, the roll pins are now located so they are 36.9 inches from the head end of the upper frame 200 and the mattress 102. The roll pins are not to be confused as being the hip pivot point, however they are on the same vertical plane as the hip pivot point of the articulee when properly positioned on his bed.

The B dimension of the model, the distance from hip pivot point to the knee pivot point, a distance of 17 inches affects parts used in the finalization or customizing of the articulating mechanism 700. See FIG. 7. The following reference numerals are used on FIGS. 1–18, and Charts A and B:

| | |
|---|---|
| 01 | Pivot Point |
| 02 | Pivot Point |
| 06 | Pivot Point |
| 09 | Pivot Point |
| 14 | Hole |
| 03 | Pivot Point |
| 04 | Pivot Point |
| 04 | Pivot Point |
| 07 | Pivot Point |
| 08 | Pivot Point |
| 11 | Pivot Point |
| 12 | Roll Pin |
| 13 | Hole |
| 100 | Invention |
| 101 | Top Layer of Mattress |

-continued

| | |
|---|---|
| 102 | Mattress |
| 103 | Lower, Serpentine Layer of Mattress |
| 105 | Cross Bar |
| 106 | Skirt |
| 107 | Lip |
| 111 | Thigh Support Pad |
| 112 | Leg Support Pad |
| 113 | Coccyx Support Pad |
| 114 | Lumbar or Torso Support Pad |
| 124 | Upper Voids in Mattress |
| 128 | Lower Voids in Mattress |
| 200 | Main Frame |
| 201 | Longitudinal Rail |
| 202 | Longitudinal Rail |
| 203 | Cross Rail |
| 300 | Pedestal Base |
| 500 | Dual Actuator |
| 504 | Motor |
| 508 | Double Reduction Worm Gear |
| 512 | Split Gear Case |
| 514 | Gear Case |
| 516 | Torque Tube |
| 603 | Sliding Plate |
| 621 | Bellcrank |
| 622 | Second Lever |
| 661 | Leg Support Bar |
| 700 | Articulating Mechanism |
| 709 | Thrust Plate |
| 711 | End Plate |
| 714 | Link |
| 731 | Fitting |
| 732 | Fitting |
| 741 | Anchor Bracket |
| 742 | Anchor Bracket |
| 761 | Drag Link |
| 762 | Drag Link |
| 767 | Attachment Bracket |
| 770 | Thigh Support Subassembly |
| 770a | First Thigh Support Bar |
| 770b | Second Thigh Support Bar |
| 775 | Lever |
| 776 | Gear Segment |
| 777 | Drive Pinion |
| 781 | Connection |
| 786 | Lateral Square Tube |
| 786a | Lateral Square Tube |
| 787 | Lateral Square Tube |
| 789 | Positioning Link |
| 791 | Stirrup |
| 900 | Orbiculator |
| 941 | Open Ended Gear Case |
| 942 | Gear Case Cover |
| 951 | Drive Gear |
| 953 | Drive Gear |
| 969 | Torso Support Bar |
| 972 | Roller |
| 981 | Rotor |
| 981a | 168 Tooth External Gear |
| 981b | 240 Tooth Internal Gear |
| 985 | Timing Gear |
| 987 | Idler Gear |
| 989 | Spur Gear Drive |
| A | Distance from the Top of the Head to the Hip Pivot Point |
| B | Distance from the Hip Pivot Point to the Knee Pivot Point |
| L1 | Fixed Dimension of Four Inches |

The anthropomorphic and quasi-anthropomorphic beds 100 of the present invention have been described with reference to a particular embodiment. Other modifications and enhancements can be made without departing from the spirit and scope of the claims that follow.

What is claimed is:

1. An adjustable bed comprising:

a. a bed frame 74 inches long to accommodate a user with a height between 56 and 68 inches;

b. a pedestal base attached to and supporting said bed frame;

c. a plurality of cross bars above said bed frame; the lengths of said cross bars being greater than the width of said bed frame;

d. a support pad on top of said cross bars; said support pad being segmented into a leg support section, a thigh support section, a coccyx support section and a torso support section;

e. a mattress on top of said support pad; said mattress being extensible;

f. a leg support bar attached under and to said cross bars under said leg support section;

g. a thigh support bar attached under and to said cross bars under said thigh support section; said thigh support bar being extensible; said thigh support bar being pivotally attached at one end to said frame and at the other end to an end of said leg support bar;

h. a torso support bar attached under and to said cross bars under said torso support section;

i. an articulating mechanism, attached to said leg and thigh support bars and said bed frame, for tilting said leg support and thigh support bars up and down, and extending and retracting said thigh support bar; said articulating mechanism positioned and designed to operate so that a user's knee pivot point is maintained vertically above said pivotal attachment between said thigh support bar and said leg support bar; and j. an orbiculating mechanism, attached to said torso support bar and said bed frame, for rotating said torso support bar in a clockwise and counterclockwise direction around the hip pivot point of a user of said adjustable bed.

2. An adjustable bed comprising:

a. a bed frame 80 inches long to accommodate a user with a height between 66 and 74 inches;

b. a pedestal base attached to and supporting said bed frame;

c. a plurality of cross bars above said bed frame; the lengths of said cross bars being greater than the width of said bed frame;

d. a support pad on top of said cross bars; said support pad being segmented into a leg support section, a thigh support section, a coccyx support section and a torso support section;

e. a mattress on top of said support pad; said mattress being extensible;

f. a leg support bar attached under and to said cross bars under said leg support section;

g. a thigh support bar attached under and to said cross bars under said thigh support section; said thigh support bar being extensible; said thigh support bar being pivotally attached at one end to said frame and at the other end to an end of said leg support bar;

h. a torso support bar attached under and to said cross bars under said torso support section;

i. an articulating mechanism, attached to said leg and thigh support bars and said bed frame, for tilting said leg support and thigh support bars up and down, and extending and retracting said thigh support bar; said articulating mechanism positioned and designed to operate so that a user's knee pivot point is maintained vertically above said pivotal attachment between said thigh support bar and said leg support bar; and j. an orbiculating mechanism, attached to said torso support bar and said bed frame, for rotating said torso support bar in a clockwise and counterclockwise direction around the hip pivot point of a user of said adjustable bed.

3. An adjustable bed comprising:

a. a bed frame 86 inches long to accommodate a user with a height between 72 and 80 inches;

b. a pedestal base attached to and supporting said bed frame;

c. a plurality of cross bars above said bed frame; the lengths of said cross bars being greater than the width of said bed frame;

d. a support pad on top of said cross bars; said support pad being segmented into a leg support section, a thigh support section, a coccyx support section and a torso support section;

e. a mattress on top of said support pad; said mattress being extensible;

f. a leg support bar attached under and to said cross bars under said leg support section;

g. a thigh support bar attached under and to said cross bars under said thigh support section; said thigh support bar being extensible; said thigh support bar being pivotally attached at one end to said frame and at the other end to an end of said leg support bar;

h. a torso support bar attached under and to said cross bars under said torso support section;

i. an articulating mechanism, attached to said leg and thigh support bars and said bed frame, for tilting said leg support and thigh support bars up and down, and extending and retracting said thigh support bar; said articulating mechanism positioned and designed to operate so that a user's knee pivot point is maintained vertically above said pivotal attachment between said thigh support bar and said leg support bar; and j. an orbiculating mechanism, attached to said torso support bar and said bed frame, for rotating said torso support bar in a clockwise and counterclockwise direction around the hip pivot point of a user of said adjustable bed.

4. An adjustable bed comprising:

a. a bed frame 92 inches long to accommodate a user with a height between 78 and 86 inches;

b. a pedestal base attached to and supporting said bed frame;

c. a plurality of cross bars above said bed frame; the lengths of said cross bars being greater than the width of said bed frame;

d. a support pad on top of said cross bars; said support pad being segmented into a leg support section, a thigh support section, a coccyx support section and a torso support section;

e. a mattress on top of said support pad; said mattress being extensible;

f. a leg support bar attached under and to said cross bars under said leg support section;

g. a thigh support bar attached under and to said cross bars under said thigh support section; said thigh support bar being extensible; said thigh support bar being pivotally attached at one end to said frame and at the other end to an end of said leg support bar;

h. a torso support bar attached under and to said cross bars under said torso support section;

i. an articulating mechanism, attached to said leg and thigh support bars and said bed frame, for tilting said leg support and thigh support bars up and down, and extending and retracting said thigh support bar; said articulating mechanism positioned and designed to operate so that a user's knee pivot point is maintained vertically above said pivotal attachment between said thigh support bar and said leg support bar; and j. an orbiculating mechanism, attached to said torso support bar and said bed frame, for rotating said torso support bar in a clockwise and counterclockwise direction around the hip pivot point of a user of said adjustable bed.

5. A method of making an adjustable bed comprising the steps of:

a. fabricating a bed frame 74 inches long to accommodate a user with a height between 56 and 68 inches;

b. fabricating a pedestal base;

c. attaching said pedestal base to the underside of said bed frame;

d. fabricating a plurality of cross bars with length greater than the width of said bed frame;

e. positioning said cross bars above said bed frame;

f. fabricating a leg support pad, a thigh support pad, a coccyx support pad and a torso support pad;

g. attaching said pads in sequence on top of said cross bars;

h. fabricating an extensible mattress;

i. placing said mattress on top of said support pads;

j. fabricating a leg support bar;

k. attaching said leg support bar under and to said cross bars under said leg support pad;

l. fabricating a thigh support bar; said thigh support bar being extensible;

m. attaching said thigh support bar under and to said cross bars under said thigh support pad;

n. pivotally attaching one end of said thigh support bar to said frame and the other end of said thigh support bar to said leg support bar;

o. fabricating a torso support bar;

p. attaching said torso support bar under and to said cross bars under said torso support pad;

q. fabricating an articulating mechanism for tilting said leg support and thigh support bars up and down, and extending and retracting said thigh support bar while maintaining a user's knee pivot point vertically above said pivotal attachment between said thigh support bar and said leg support bar;

r. attaching said articulating mechanism to said leg and thigh support bars and said bed frame so that a user's knee pivot point is vertically above said pivotal attachment between said thigh support bar and said leg support bar;

s. fabricating an orbiculating mechanism for rotating said torso support bar in a clockwise and counterclockwise direction around the hip pivot point of said user; and t. attaching said orbiculating mechanism to said torso support bar and said bed frame.

6. A method of making an adjustable bed comprising the steps of:

a. fabricating a bed frame 80 inches long to accommodate a user with a height between 66 and 74 inches;

b. fabricating a pedestal base;

c. attaching said pedestal base to the underside of said bed frame;

d. fabricating a plurality of cross bars with length greater than the width of said bed frame;

e. positioning said cross bars above said bed frame;

f. fabricating a leg support pad, a thigh support pad, a coccyx support pad and a torso support pad;

g. attaching said pads in sequence on top of said cross bars;

h. fabricating an extensible mattress;

i. placing said mattress on top of said support pads;

j. fabricating a leg support bar;

k. attaching said leg support bar under and to said cross bars under said leg support pad;

l. fabricating a thigh support bar; said thigh support bar being extensible;

m. attaching said thigh support bar under and to said cross bars under said thigh support pad;

n. pivotally attaching one end of said thigh support bar to said frame and the other end of said thigh support bar to said leg support bar;

o. fabricating a torso support bar;

p. attaching said torso support bar under and to said cross bars under said torso support pad;

q. fabricating an articulating mechanism for tilting said leg support and thigh support bars up and down, and extending and retracting said thigh support bar while maintaining a user's knee pivot point vertically above said pivotal attachment between said thigh support bar and said leg support bar;

r. attaching said articulating mechanism to said leg and thigh support bars and said bed frame so that a user's knee pivot point is vertically above said pivotal attachment between said thigh support bar and said leg support bar;

s. fabricating an orbiculating mechanism for rotating said torso support bar in a clockwise and counterclockwise direction around the hip pivot point of said user; and t. attaching said orbiculating mechanism to said torso support bar and said bed frame.

7. A method of making an adjustable bed comprising the steps of:

a. fabricating a bed frame 86 inches long to accommodate a user with a height between 72 and 80 inches;

b. fabricating a pedestal base;

c. attaching said pedestal base to the underside of said bed frame;

d. fabricating a plurality of cross bars with length greater than the width of said bed frame;

e. positioning said cross bars above said bed frame;

f. fabricating a leg support pad, a thigh support pad, a coccyx support pad and a torso support pad;

g. attaching said pads in sequence on top of said cross bars;

h. fabricating an extensible mattress;

i. placing said mattress on top of said support pads;

j. fabricating a leg support bar;

k. attaching said leg support bar under and to said cross bars under said leg support pad;

l. fabricating a thigh support bar; said thigh support bar being extensible;

m. attaching said thigh support bar under and to said cross bars under said thigh support pad;

n. pivotally attaching one end of said thigh support bar to said frame and the other end of said thigh support bar to said leg support bar;

o. fabricating a torso support bar;

p. attaching said torso support bar under and to said cross bars under said torso support pad;

q. fabricating an articulating mechanism for tilting said leg support and thigh support bars up and down, and extending and retracting said thigh support bar while maintaining a user's knee pivot point vertically above said pivotal attachment between said thigh support bar and said leg support bar;

r. attaching said articulating mechanism to said leg and thigh support bars and said bed frame so that a user's knee pivot point is vertically above said pivotal attachment between said thigh support bar and said leg support bar;

s. fabricating an orbiculating mechanism for rotating said torso support bar in a clockwise and counterclockwise direction around the hip pivot point of said user; and t. attaching said orbiculating mechanism to said torso support bar and said bed frame.

8. A method of making an adjustable bed comprising the steps of:

a. fabricating a bed frame 92 inches long to accommodate a user with a height between 78 and 86 inches;

b. fabricating a pedestal base;

c. attaching said pedestal base to the underside of said bed frame;

d. fabricating a plurality of cross bars with length greater than the width of said bed frame;

e. positioning said cross bars above said bed frame;

f. fabricating a leg support pad, a thigh support pad, a coccyx support pad and a torso support pad;

g. attaching said pads in sequence on top of said cross bars;

h. fabricating an extensible mattress;

i. placing said mattress on top of said support pads;

j. fabricating a leg support bar;

k. attaching said leg support bar under and to said cross bars under said leg support pad;

l. fabricating a thigh support bar; said thigh support bar being extensible;

m. attaching said thigh support bar under and to said cross bars under said thigh support pad;

n. pivotally attaching one end of said thigh support bar to said frame and the other end of said thigh support bar to said leg support bar;

o. fabricating a torso support bar;

p. attaching said torso support bar under and to said cross bars under said torso support pad;

q. fabricating an articulating mechanism for tilting said leg support and thigh support bars up and down, and extending and retracting said thigh support bar while maintaining a user's knee pivot point vertically above said pivotal attachment between said thigh support bar and said leg support bar;

r. attaching said articulating mechanism to said leg and thigh support bars and said bed frame so that a user's knee pivot point is vertically above said pivotal attachment between said thigh support bar and said leg support bar;

s. fabricating an orbiculating mechanism for rotating said torso support bar in a clockwise and counterclockwise direction around the hip pivot point of said user; and t. attaching said orbiculating mechanism to said torso support bar and said bed frame.

* * * * *